United States Patent [19]

Helton, III et al.

[11] Patent Number: 4,703,404

[45] Date of Patent: Oct. 27, 1987

[54] PORTABLE LIGHTING DEVICE

[75] Inventors: Charles J. Helton, III, Camarillo, Calif.; George N. Panagiotou, 5723 Auckland Ave., North Hollywood, Calif. 91601

[73] Assignee: George N. Panagiotou, North Hollywood, Calif.

[21] Appl. No.: 234,945

[22] Filed: Feb. 17, 1981

[51] Int. Cl.[4] ..... F21V 29/00

[52] U.S. Cl. ..... 362/294; 362/109; 362/427; 362/444

[58] Field of Search ..... 362/109, 294, 427, 444

[56] References Cited

U.S. PATENT DOCUMENTS

| | | | |
|---|---|---|---|
| 3,126,785 | 3/1964 | Zillmer | 362/294 X |
| 3,140,053 | 7/1964 | Lowell | 362/294 X |
| 3,461,282 | 8/1969 | Martinez | 362/294 X |
| 3,541,492 | 11/1970 | Fenn | 362/294 X |
| 3,639,751 | 2/1972 | Pichel | 362/294 X |
| 3,689,761 | 9/1972 | Rosen et al. | 362/294 X |
| 3,936,686 | 2/1976 | Moore | 362/294 X |

*Primary Examiner*—Peter A. Nelson

*Attorney, Agent, or Firm*—Kenneth J. Hovet

[57] ABSTRACT

A portable electric lighting device is provided having an open top closable by two rotatable members oppositely hinged. The members allow easy access to the interior of the device for bulb, light filter or lens changing. Heat from the lamp is dissipated by including air vents in the members and constructing at least one member with heavy heat conductive material. The device includes a bulb ejector lever and resilient biasing wires to maintain the bulb in a secure position.

12 Claims, 4 Drawing Figures

PORTABLE LIGHTING DEVICE

BACKGROUND OF THE INVENTION

1. Field Of The Invention

The present invention relates to electrical lighting fixtures and, more particularly, to a portable high wattage lighting device.

2. Description Of The Prior Art

Heretofore, it has been technically difficult to combine the use of a high wattage bulb with a small-scale lighting fixture. Generally, problems inherent in dissipating heat emanating from bulbs capable of producing light of an intensity comparable to that used for photographic or stage lighting have drastically limited the wattage level allowable in smaller fixtures. Prior art high wattage devices require bulky and cumbersome ancillary parts such as fans, heat transfer appendages, power vents, cooling coils, etc., for removing the excessive heat. Obviously, such parts necessitate large and heavy equipment which are unwieldy and generally lack portability. Further, the presence of such heat dissipating parts complicate operation, use and repair thereby resulting in higher costs.

SUMMARY OF THE INVENTION

The present invention provides a small-scale electric stage light adapted for hand use or mounting upon a pedestal that does not overheat and is easy to operate and maintain. A U-shaped housing having an open front end and top is provided to support a bulb and bulb mounting assembly. An especially unique feature of the invention resides in the use of two rotatable members, each separately hinged to respective upper opposite ends of the housing. In this manner each of the members can rotate towards or away from each other to close the housing or provide ready access to the housing interior.

DESCRIPTION OF THE PREFERRED EMBODIMENTS

Figure 1:
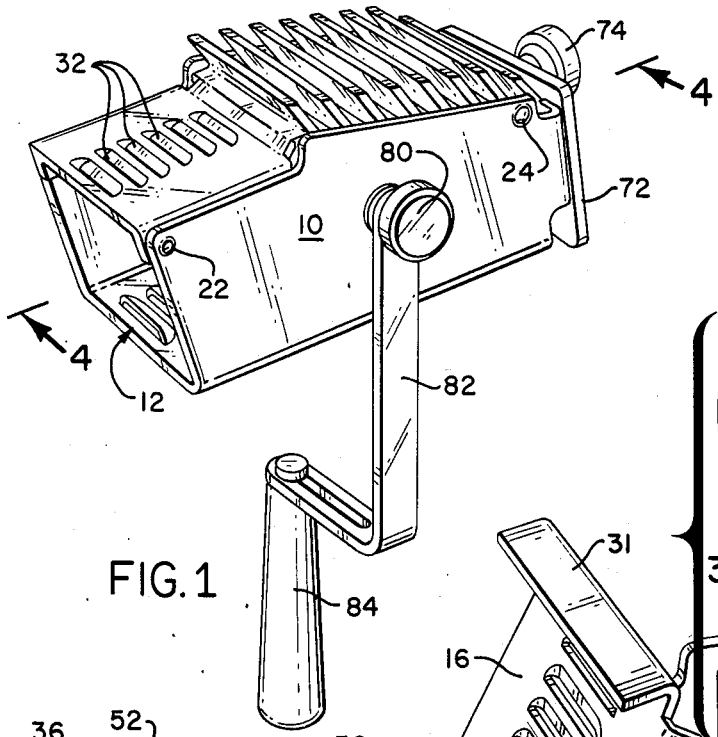
FIG. 1 is a perspective view of the portable lighting device of the present invention.
Figure 2:
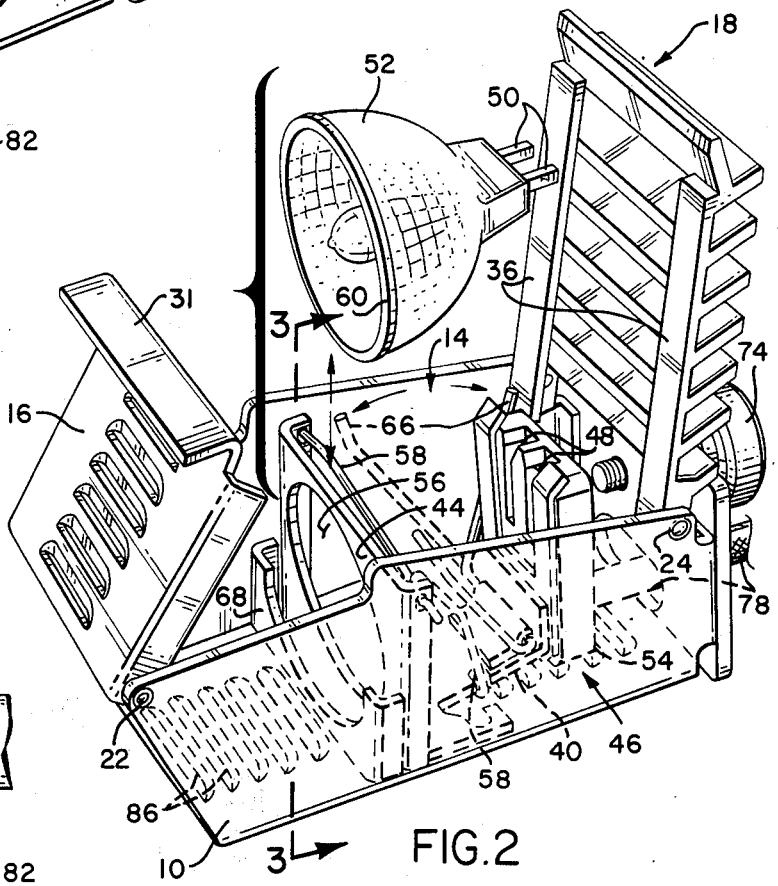
FIG. 2 is an enlarged partial view of the device of FIG. 1 showing housing cover members in an open position with the bulb removed.
Figure 3:
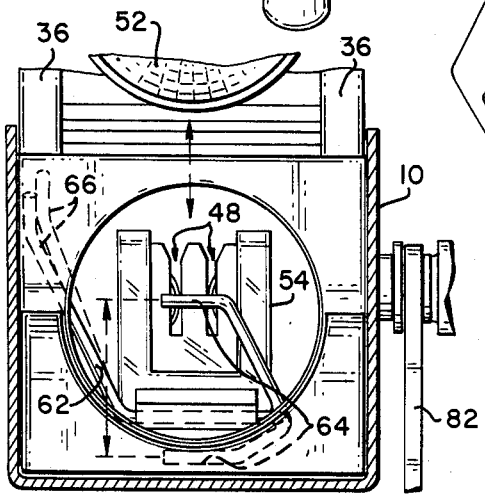
FIG. 3 is a cross-sectional view taken along lines 3—3 of FIG. 2.

Referring now to the drawings, there shown a portable electric lighting device constructed in accordance with the teachings of the present invention. The device consists of a housing (10) having an open front end (12) and an open top (14).

The open top is closable by a first cover member (16) and a second cover member (18). Both cover members are hinged for rotation to opposing upper corner portions (22) and (24) of the housing. In this manner each of the cover members can be rotated with their free ends towards or away from each other thereby allowing complete access to the housing interior while being closable during operation of the lighting device.

Figure 4:
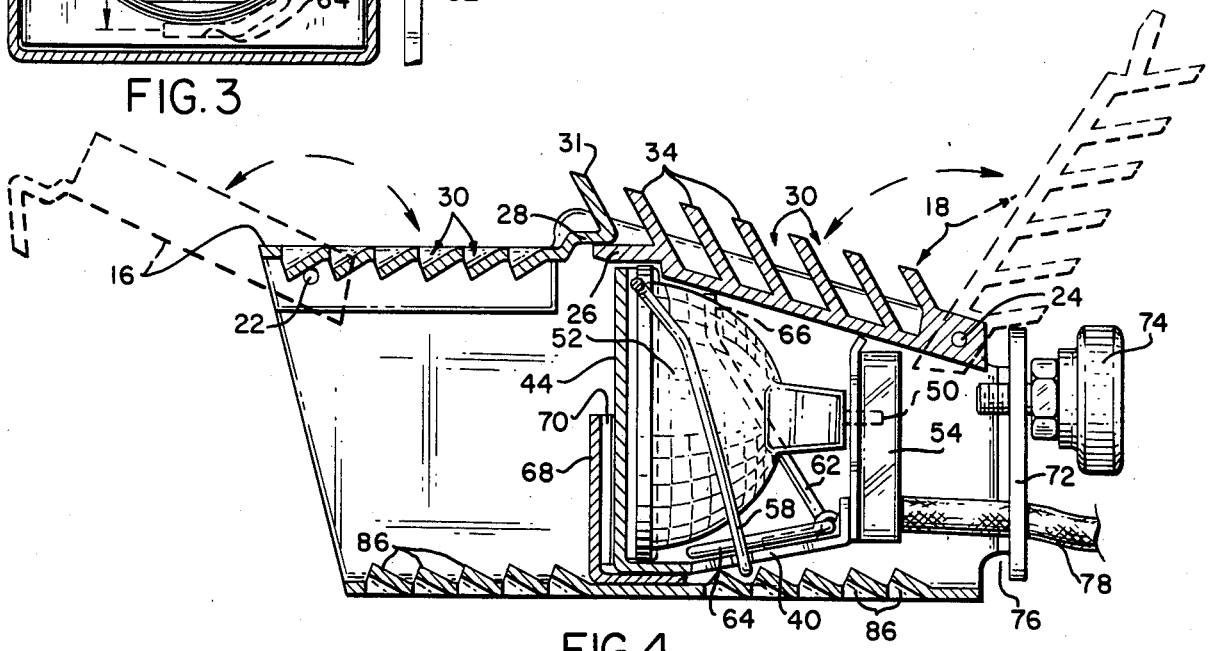
FIG. 4 is a cross-sectional view taken along lines 4—4 of FIG. 1.

As best shown in FIG. 4, the free end of the second cover member is provided with an outwardly extending lip portion (26) and the free end of the first cover member includes an offset outwardly extending flange portion (28). In this manner, when the two members are in a closed position over the housing, the outwardly extending flange portion of the first member will overlie and engage the lip portion of the second member.

It will be noted that the cover members are sized to cover the open top (14) of the housing when rotated to a closed position and both are adapted to vent hot air through openings (30). In the first member, such openings comprise louvres (32) formed by indentations across the cover member top. Openings in cover member (18) are defined by a plurality of transversely extending inclined vanes (34). The vanes are secured to base members (36) that extend parallel to the housing sidewalls. Preferably, the second member is a heavy metallic member that functions as a heat sink in a manner to be hereinafter described.

A base frame (40) is secured to the inside bottom of the housing. The frame is part of a bulb mounting assembly and includes an upright apertured plate (44) and electrical contact part (46). The electric contact part is adapted to frictionally engage through opposing metallic clips (48) corresponding metallic prongs (50) of the bulb (52). The clips (48) conduct electricity to the bulb through power cord (78) from an electric power source (not shown). The clips are secured to a ceramic insulative material (54) which is, in turn, secured to the aforementioned base frame (40).

As shown in FIG. 4, the apertured plate (44) is integral with the base frame and extends across the width of the housing at a location proximate the housing midpoint. Preferably, the plate (44) is spaced apart from contact part (46) a distance about equal to the length of bulb (52). Plate (44) has a height about equivalent to the height of the housing sidewalls and provides an abutment across its top edge for lip (26). Aperture (56) of the plate (44) is concentric with the round face of bulb (52) and has a diameter slightly less than the diameter of the bulb face rim (60) for a purpose to be hereinafter described.

Connected to the upper opposing corners of the apertured plate are spring-biasing means comprising a pair of resilient wires (58). Each wire extends diagonally away from respective opposing corners of the plate and downwardly to a secure position beneath the frame (40) in a manner to exert a bias against opposing exterior side surfaces of the bulb. Having the resilient wires extend about both sides of the bulb outer surfaces allows the bulb to be retained in proper alignment within the housing by forcing the bulb front rim surface (60) against the apertured plate (44). In this way the bulb is firmly retained within the housing and will not readily become dislodged during usage of the device.

To facilitate removal of the bulb without damage, an ejector means is provided comprising a lever (62) pivotally mounted upon the base frame (40). The lever includes an arm portion (64) underlying the bulb and an upstanding portion (66) located adjacent the bulb along an inner sidewall of the housing. For removal of the bulb, one manually grasps the upstanding portion (66) and rotates it toward the rear of the housing causing the arm portion (64) to exert an upward force against the bottom of the bulb and cause its dislodgement from the spring clips (48) and resilient wires (58). The angular displacement between the arm portion and underlying portion, as viewed in FIG. 4, is sufficient to offset the arm from the bulb and allow easy grasping of the arm portion while still allowing for sufficient rotation to dislodge the bulb.

The housing interior further includes a mounting bracket (68) extending across the interior thereof. The bracket is preferably adjacent the apertured plate (44) and comprises a plate member offset from the front surface of the apertured plate a distance sufficient to provide an inset area (70) that allows for the insertion of light filters, lenses, bulb protector, color frames or the like.

The housing is further provided with a back plate (72) upon which is mounted knob (74). The plate extends across the back end of the housing and is provided with an outlet (76) that allows power cord (78) to pass for connection to the electrical power source.

Connected to one of the housing sidewalls is mounting knob (80) to which is secured a bracket (82). Handle member (84) is detachably connected to the bracket and provides for manual manipulation of the lighting device. The knob (80) is threaded and can be rotated to loosen the bracket for angular adjustment and alignment of the housing. The handle (84) may be detached and the bracket mounted on stationary means, such as a pedestal or the like. Knob (74), of course, further assists in manually adjusting the device.

A particularly advantageous feature of the present invention resides not only in its size, but ability to dissipate heat emanating from the bulb (52). The aforementioned second member (18) facilitates removal of heat by the high heat conductivity of the material of construction. The member is typically a cast or molded aluminum part that readily conducts heat while being light in weight.

The bottom of the housing may optionally further include louvres having openings therethrough shown by reference numeral (86). The inclusion of such louvres allows for the flow of air into and out of the housing, further facilitating the heat removal advantages of the invention.

A further advantage of the invention resides in its ease of use. Note the upwardly inclined end portion (31) extending from flange member (28). The end portion is inclined at an angle co-extensive with the vanes (34) so that, in addition to being aesthetically pleasing, it may readily be grasped for lifting the first cover member away from lip (26) and rotating it to the position shown in phantom in FIG. 4. Similarly, the heavier second cover member (18) may thereafter be grasped by either the outwardly extending lip portion (26) or one of the vanes near the free end of the member for rotation rearwardly to the position shown in phantom in FIG. 4. When the housing is thusly opened, there is ready access to the housing interior.

When the housing is to be closed for operation, the above-described procedure is repeated in reverse wherein the second member (18) is rotated downwardly so that the outwardly extending lip (26) rests upon the top edge of apertured plate (44). Subsequently, cover member (16) is rotated to a position where outwardly extending offset flange (28) rests upon the upper surfaces of the lip (26).

While the invention has been described with respect to a preferred embodiment, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

We claim:

1. An electric portable lamp comprising a housing having an open front end and an open top which is closable by first and second members each of which are hinged to upper opposing end portions of said housing whereby the free ends of said members are adjacent each other when closed over the housing top;

a bulb mounting assembly positioned within said housing having a bulb mounted therein directed toward the housing open front end, said assembly including a bottom frame secured to said housing supporting an electric contact means for supplying electric power to said bulb; and, a plate secured within said housing having an aperture aligned with said housing front end.

2. The lamp of claim 1 wherein at least one of said members includes openings therethrough for the passage of air.

3. The lamp of claim 2 wherein at least one of said members comprises a heat sink.

4. The lamp of claim 1 including spring biasing means mounted in said housing for pressing against the exterior surfaces of said bulb to maintain said bulb in a secure position.

5. The lamp of claim 4 wherein said apertured plate extends across said housing and is spaced apart from said contact means a distance about equal to the length of said bulb and wherein said spring biasing means comprises resilient wire secured to said frame and the upper portion of said apertured plate in a manner to exert a bias against said bulb proximate opposing side surfaces thereof.

6. The lamp of claim 2 wherein the openings of at least one of said members include a plurality of upwardly inclined vanes.

7. The lamp of claim 1 including bulb ejector means comprising a lever pivotaby mounted on said bottom frame having an arm portion underlying said bulb and an upstanding portion adjacent said bulb whereby manual rotation of said upstanding portion will cause said arm portion to exert an upward force against the bulb causing its dislodgement from said contact means.

8. The lamp of claim 5 including a mounting bracket located co-extensive with said apertured plate within said housing.

9. The lamp of claim 2 wherein the free end of one of said members includes an outwardly extending lip portion and the free end of the other of said members includes an offset outwardly extending flange portion whereby said flange portion overlies said lip portion when said members are closed together over said housing open top.

10. The lamp of claim 1 wherein said housing is about U-shaped in cross-section and includes a plate across the back end thereof.

11. The lamp of claim 3 wherein said member closest said bulb comprises said heat sink and is constructed of metal.

12. The lamp of claim 10 wherein said housing includes handle means attached thereto for manually manipulating said lamp.

* * * * *